US006810668B2

(12) United States Patent
Nagatani et al.

(10) Patent No.: US 6,810,668 B2
(45) Date of Patent: Nov. 2, 2004

(54) STEAM TEMPERATURE CONTROL SYSTEM FOR EVAPORATOR

(75) Inventors: Shuji Nagatani, Wako (JP); Susumu Maeda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 26 days.

(21) Appl. No.: 10/398,478

(22) PCT Filed: Oct. 1, 2001

(86) PCT No.: PCT/JP01/08637

§ 371 (c)(1),
(2), (4) Date: Sep. 17, 2003

(87) PCT Pub. No.: WO02/29335

PCT Pub. Date: Apr. 11, 2002

(65) Prior Publication Data

US 2004/0040301 A1 Mar. 4, 2004

(30) Foreign Application Priority Data

Oct. 5, 2000 (JP) ..... 2000-311680

(51) Int. Cl.[7] ..... F02G 3/00

(52) U.S. Cl. ..... 60/615; 60/616; 60/617; 60/618

(58) Field of Search ..... 60/614, 615, 616, 60/617, 618

(56) References Cited

U.S. PATENT DOCUMENTS 4,257,232 A * 3/1981 Bell ..... 60/676
4,586,338 A 5/1986 Barrett et al.
4,920,750 A * 5/1990 Iishiki et al. ..... 60/671
5,896,746 A * 4/1999 Platell ..... 60/618
6,324,849 B1 * 12/2001 Togawa et al. ..... 60/616
6,435,420 B1 * 8/2002 Kasai et al. ..... 237/12.1
6,492,741 B1 * 12/2002 Morimoto et al. ..... 290/40 C

FOREIGN PATENT DOCUMENTS

| | | |
|---|---|---|
| JP | 61-16550 A | 7/1986 |
| JP | 63-99464 A | 4/1988 |
| JP | 2-38161 | 10/1990 |
| JP | 2-38162 | 10/1990 |
| JP | 2-38162 Y2 | 10/1990 |

* cited by examiner

*Primary Examiner*—Hoang Nguyen
(74) *Attorney, Agent, or Firm*—Birch, Stewart, Kolasch & Birch, LLP

(57) ABSTRACT

In order to control an actual temperature of a vapor generated by en evaporator (3) for heating water by an exhaust gas from an engine (1) to a target vapor temperature by varying the amount of water supplied from a supplied-water amount control injector (7), a control unit (11) controls the amount of water supplied in a feedforward manner in accordance to an engine rotational speed and an intake negative pressure and controls the amount of water supplied in a feedback manner based on a difference between the actual vapor temperature and the target vapor temperature. It is possible to control the actual temperature of the vapor generated by the evaporator (3) to the target vapor temperature with a high accuracy even in a transient state of the engine (1) by correcting a feedforward control value using at least one of a fuel-cut control signal, an ignition-retarding control signal, an EGR control signal and an air fuel ratio control signal which are parameters indicating a burned state of the engine (1).

3 Claims, 8 Drawing Sheets

STEAM TEMPERATURE CONTROL SYSTEM FOR EVAPORATOR

This application is the national phase under 35 U.S.C. §371 of PCT International Application No. PCT/JP01/08637 which has an International filing date of Oct. 1, 2001, which designated the United States of America.

FIELD OF THE INVENTION

The present invention relates to a vapor-temperature control system for an evaporator for controlling an actual temperature of a vapor generated by an evaporator for heating a liquid-phase working medium by an exhaust gas from an engine to a target vapor temperature.

BACKGROUND ART

There are vapor-temperature control systems conventionally known from Japanese Utility Model Publication Nos. 2-38161 and 2-38162, wherein in order to vary the amount of water supplied to a waste heat recovery boiler for recovering a heat energy of an exhaust gas from an engine to control an actual vapor temperature to a target vapor temperature, a feedforward control value is calculated based on a throttle opening degree in the engine, and a feedback control value is calculated based on a difference between the actual vapor temperature and the target vapor temperature, whereby the amount of water supplied to the waste heat recovery boiler is controlled by a value resulting from the addition of the feedforward control value and the feedback control value to each other.

For example, in an engine for an automobile, various controls such as a fuel-cut control, an ignition-retarding control, an EGR control and an air fuel ratio control are carried out for the purpose of varying the burned state of the engine and hence, they exert a direct influence to the temperature of an exhaust gas. Therefore, in an engine in which the various controls are carried out, it is difficult to control the temperature of a vapor with a good responsiveness and accurately in a transient state of the engine.

DISCLOSURE OF THE INVENTION

The present invention has been accomplished with the above circumstances in view, and it is an object of the present invention to control the temperature of a vapor generated by an evaporator operated by an exhaust gas from an engine with a high accuracy even in a transient state of the engine.

To achieve the above object, according to a first aspect and feature of the present invention, there is proposed a vapor-temperature control system for an evaporator for controlling an actual temperature of a vapor generated by an evaporator for heating a liquid-phase working medium by an exhaust gas from an engine to a target vapor temperature, characterized in that the system comprises a liquid-phase working medium supply amount varying means for varying the amount of liquid-phase working medium supplied to the evaporator, and a control means for controlling the amount of liquid-phase working medium supplied by the liquid-phase working medium supply amount varying means, based on a parameter indicating the burned state of the engine.

With the above arrangement, when the liquid-phase working medium is supplied to the evaporator operated by the exhaust gas from the engine, the amount of liquid-phase working medium supplied is controlled based on the parameter indicating the burned state of the engine which exerts an influence directly to the temperature of the exhaust gas. Therefore, the actual temperature of the vapor generated by the evaporator can be controlled to the target vapor temperature with a high accuracy even in a transient state of the engine.

According to a second aspect and feature of the present invention, in addition to the first feature, the parameter indicating the burned state of the engine is at least one of a fuel-cut control signal, an ignition-retarding control signal, an EGR control signal and an air fuel ratio control signal.

With the above arrangement, the amount of liquid-phase working medium supplied is controlled based on at least one of the fuel-cut control signal, the ignition-retarding control signal, the EGR control signal and the air fuel ratio control signal. Therefore, the burned state of the engine can be reflected properly, and the actual temperature of the vapor can be controlled with a high accuracy.

According to a third aspect and feature of the present invention, in addition to the first or second feature, the control means includes a feedforward control means for controlling the amount of liquid-phase working medium supplied in accordance with an engine rotational speed and an engine load, and a feedback control means for controlling the amount of liquid-phase working medium supplied, based on a difference between the actual vapor temperature and the target vapor temperature.

With the above arrangement, the following controls are used: the feedforward control for controlling the amount of liquid-phase working medium supplied in accordance with the engine rotational speed and the engine load, and the feedback control for controlling the amount of liquid-phase working medium supplied, based on the difference between the actual vapor temperature and the target vapor temperature. Therefore, it is possible to achieve both of the responsiveness and the convergence of the control for equalizing the actual vapor temperature to the target vapor temperature.

A supplied-water amount control injector 7 in an embodiment corresponds to the liquid-phase working medium supply amount varying means of the present invention; a vapor temperature control unit 11 in the embodiment corresponds to the control means of the present invention; a feedforward control section 17 in the embodiment corresponds to the feedforward control means of the present invention; a feedback control section 18 in the embodiment corresponds to the feedback control means of the present invention; and an intake negative pressure PB in the embodiment corresponds to the engine load of the present invention.

BRIEF DESCRIPTION OF THE DRAWINGS

FIG. 1 is a diagram showing the entire arrangement of a vapor-temperature control unit for Rankine cycle system mounted on a vehicle;

FIG. 2 is a block diagram of a control system for the vapor-temperature control unit;

FIG. 3 is a flow chart for a vapor temperature control;

FIG. 4 is a diagram showing a map for searching an energy of an exhaust gas from an engine rotational speed and an intake negative pressure;

FIG. 5 is a diagram showing a map for searching the energy of the exhaust gas from a time elapsed from the fuel cutting;

FIG. 6 is a diagram showing a map for searching the temperature of the exhaust gas from an ignition-retarding control signal;

FIG. 7 is a diagram showing a map for searching the temperature of the exhaust gas from an EGR control signal; and FIG. 8 is a diagram showing a map for searching the temperature of the exhaust gas from an air fuel ratio control signal.

BEST MODE FOR CARRYING OUT THE INVENTION

An embodiment of the present invention will now be described with reference to FIGS. 1 to 8.

Figure 1:
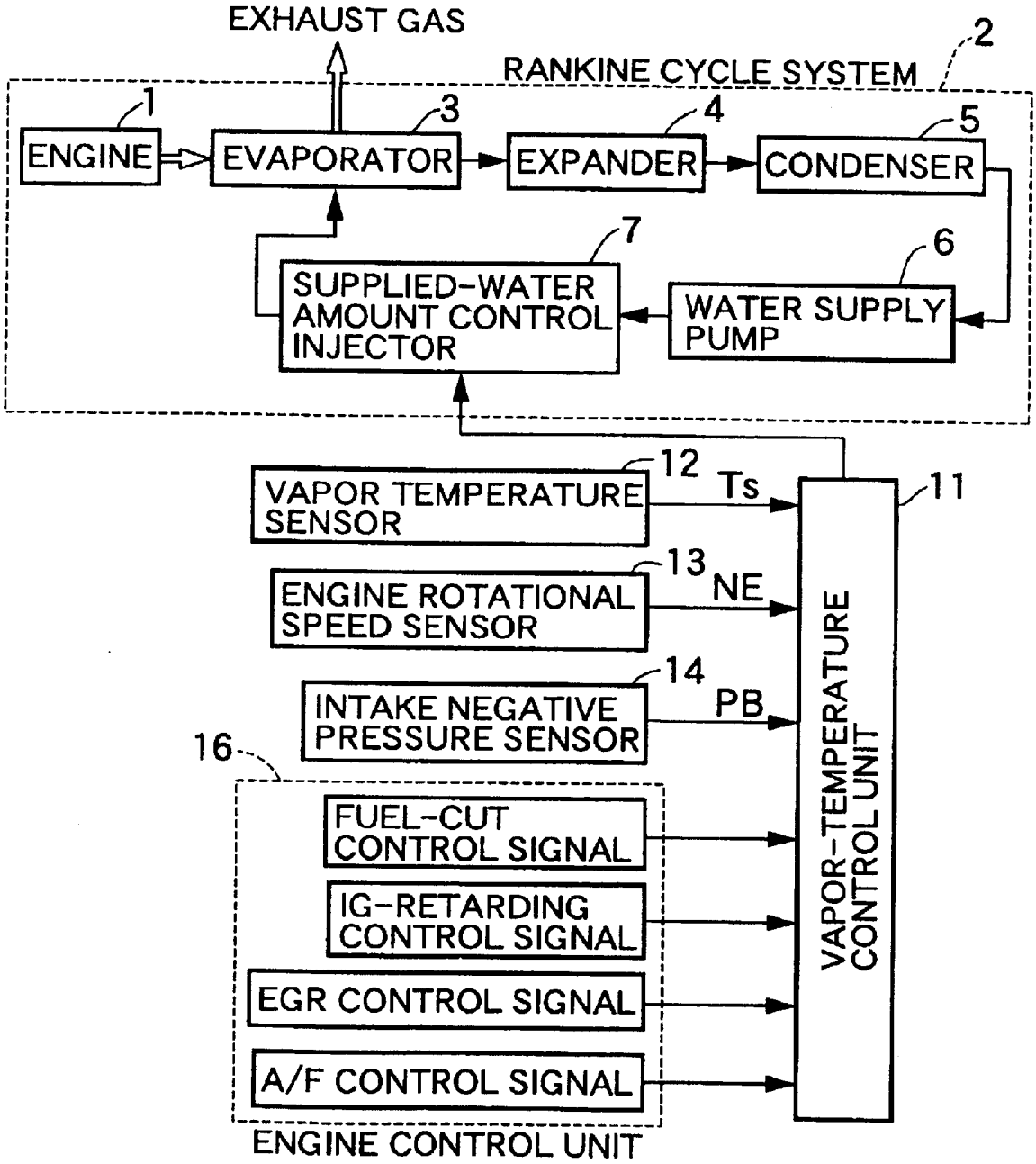
FIGS. 1 to 8 show an embodiment of the present invention.

As shown in FIG. 1, a Rankine cycle system 2 operated by an engine 1 mounted on a vehicle has a known structure and includes an evaporator 3 for generating a high-temperature and high-pressure vapor using a waste heat from the engine 1, e.g., an exhaust gas as a heat source, an expander 4 for generating a shaft output by the expansion of the high-temperature and high-pressure vapor, a condenser 5 for condensing a dropped-temperature and dropped-pressure vapor discharged from the expander 4 back to water, a water supply pump 6 for pressurizing the water from the condenser 5, and a supplied-water amount control injector 7 for controlling the amount of water supplied from the water supply pump 6 to the evaporator 3. Input to a vapor-temperature control unit 11 comprising a microcomputer are signals from a vapor temperature sensor 12 mounted in the evaporator 3 for detecting an actual temperature Ts of vapor, an engine rotational speed sensor 13 mounted in the engine 1 for detecting an engine rotational speed NE, and an intake negative pressure sensor 14 mounted in the engine 1 for detecting an intake negative pressure PB, and further signals indicating a burned state from an engine control unit 16 for controlling the operational state of the engine 1, namely, a fuel-cut control signal, an ignition-retarding control signal, an EGR control signal and an air fuel ratio control signal.

Figure 2:
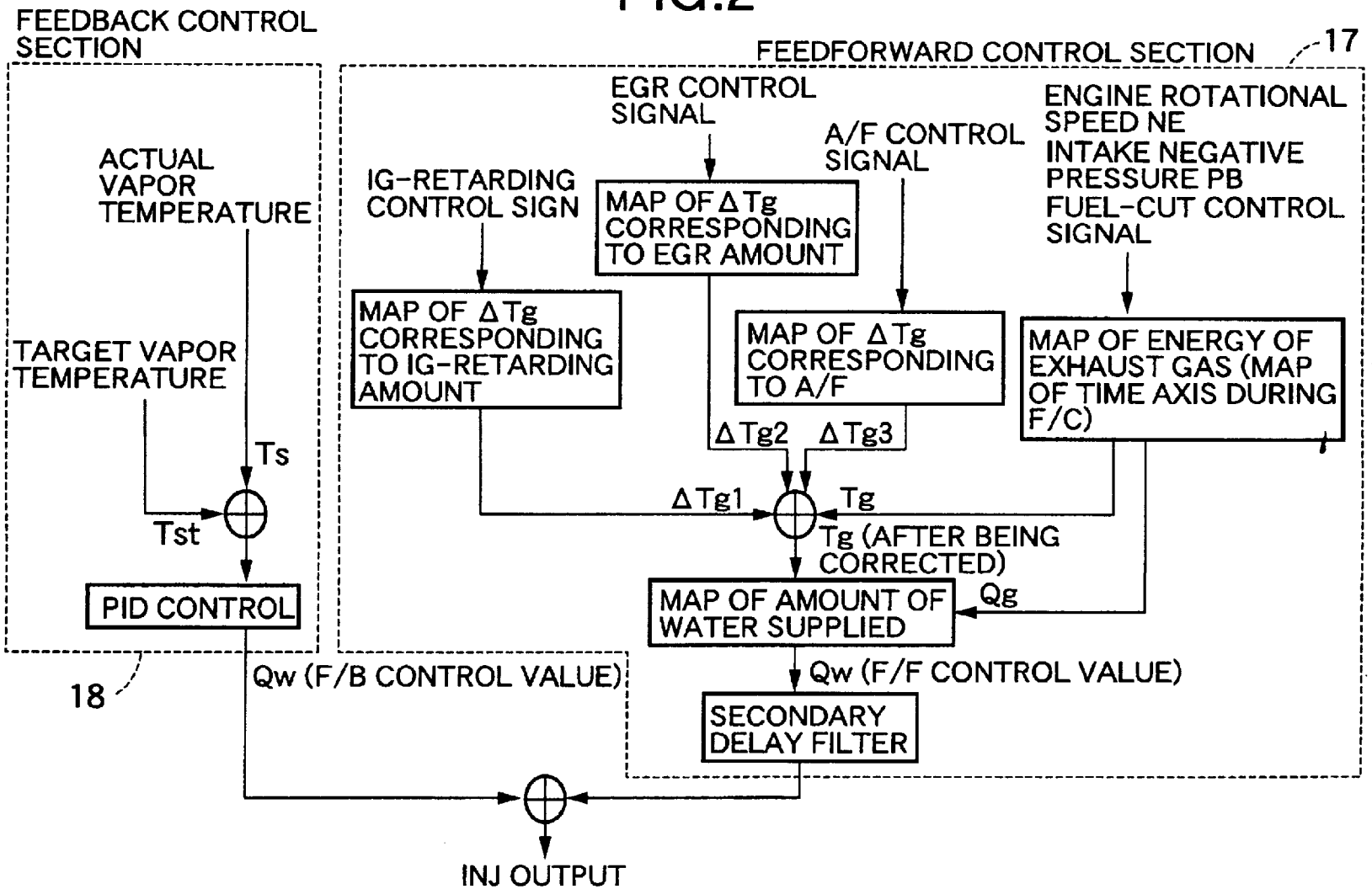

As shown in FIG. 2, the vapor temperature control unit 11 includes a feedforward control section 17 and a feedback control section 18. In the feedforward control section 17, an energy of an exhaust gas, i.e., a temperature Tg of the exhaust gas and a flow rate Qg of the exhaust gas are searched based on an engine rotational speed NE detected by the engine rotational speed sensor 13, an intake negative pressure PB detected by the intake negative pressure sensor 14 and the fuel-cut control signal from the engine control unit 16. Amounts ΔTg1, ΔTg2 and ΔTg3 of drop in temperature of the exhaust gas corresponding to the ignition-retarding control signal, the EGR control signal and the air fuel ratio control signal which are the signals indicating the burned state of the engine 1 are also searched from a map. The three amounts ΔTg1, ΔTg2 and ΔTg3 of drop in temperature of the exhaust gas searched from the ignition-retarding control signal, the EGR control signal and the air fuel ratio control signal are added to the temperature Tg of the exhaust gas searched from the engine rotational speed NE, the intake negative pressure PB and the fuel-cut control signal to correct the temperature Tg ($Tg \leftarrow Tg+\Delta Tg1+\Delta Tg2+\Delta Tg3$). Then, an amount Qw of water supplied for equalizing an actual temperature Ts of the vapor generated in the evaporator 3 to a target vapor temperature Tst is searched based on the flow rate Qg of the exhaust gas searched from the engine rotational speed NE and the intake negative pressure PB and the corrected temperature Tg of the exhaust gas, and is then filtered in a secondary delay filter with heat capacities of the engine 1 and the evaporator 3 taken into consideration to calculate a feedforward control value.

On the other hand, a difference Ts−Tst between the actual vapor temperature Ts detected by the vapor temperature sensor 12 and the preset target vapor temperature Tst is calculated and subjected to a PID processing to calculate a feedback control value, and the amount of water supplied to the evaporator 3 by the supplied-water amount control injector 7 is controlled based on a value resulting from the addition of the feedforward control value and the feedback control value to each other. Thus, the actual temperature Ts of the vapor generated upon the decrease in the amount Qw of water supplied to the evaporator 3 is increased, and the actual temperature Ts of the vapor generated upon the increase in the amount Qw of water supplied to the evaporator 3 is decreased.

Figure 3:
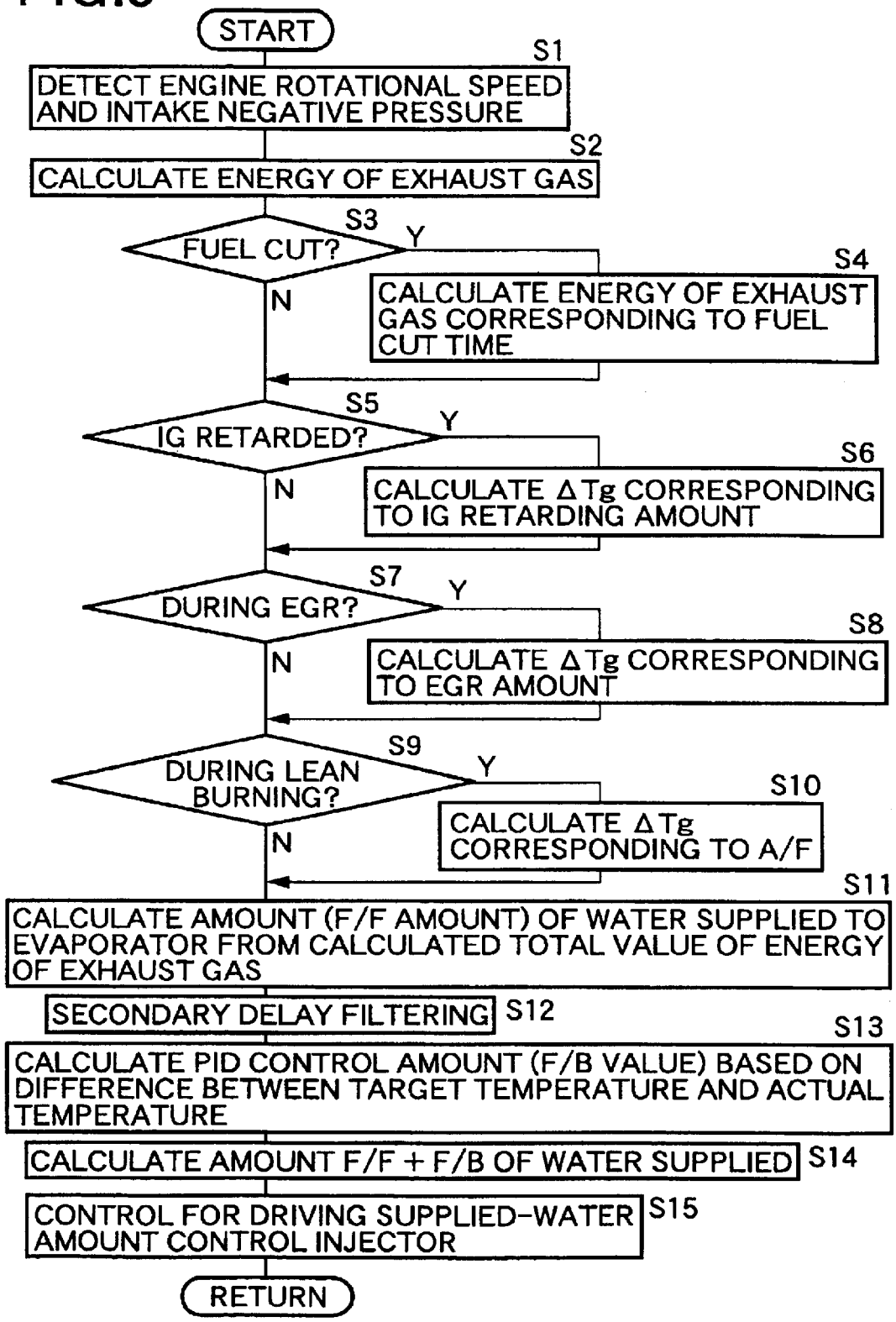
Figure 4:
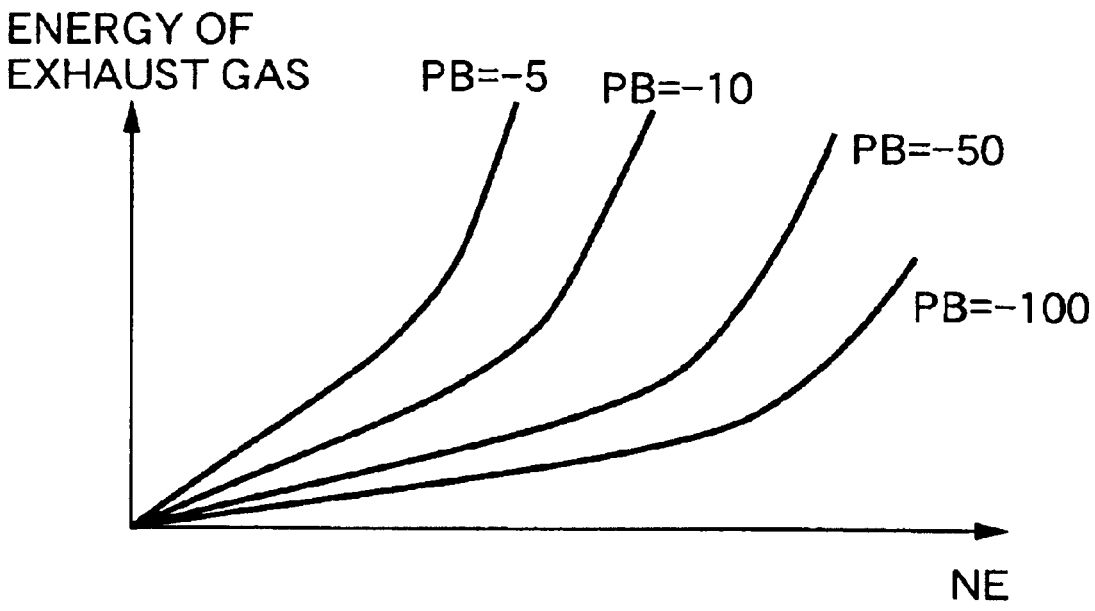
Figure 5:
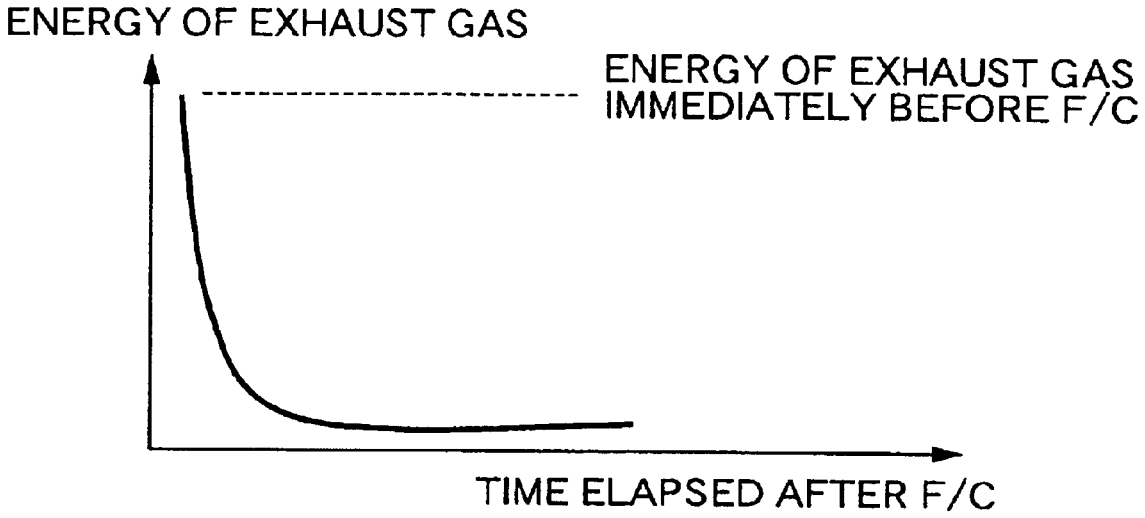

The above-described operation will be further described with reference to a flow chart shown in FIG. 3.

First, at Step S1, an engine rotational speed NE is detected by the engine rotational speed sensor 13, and an intake negative pressure PB is detected by the intake negative pressure sensor 14. At subsequent Step S2, an energy of an exhaust gas is searched from a map shown in FIG. 4. As apparent from the map shown in FIG. 4, the more the engine rotational speed NE is increased, the more the energy of the exhaust gas is increased, and the more the intake negative pressure PB is decreased, the more the energy of the exhaust gas is increased. If the engine 1 is in a fuel-cut operation at subsequent Step S3, the energy of the exhaust gas is corrected in accordance with a time elapsed from the start of the fuel-cutting at Step S4. As apparent from FIG. 5, the energy of the exhaust gas is decreased steeply in accordance with an increase in time elapsed from the start of the fuel-cutting.

Figure 6:
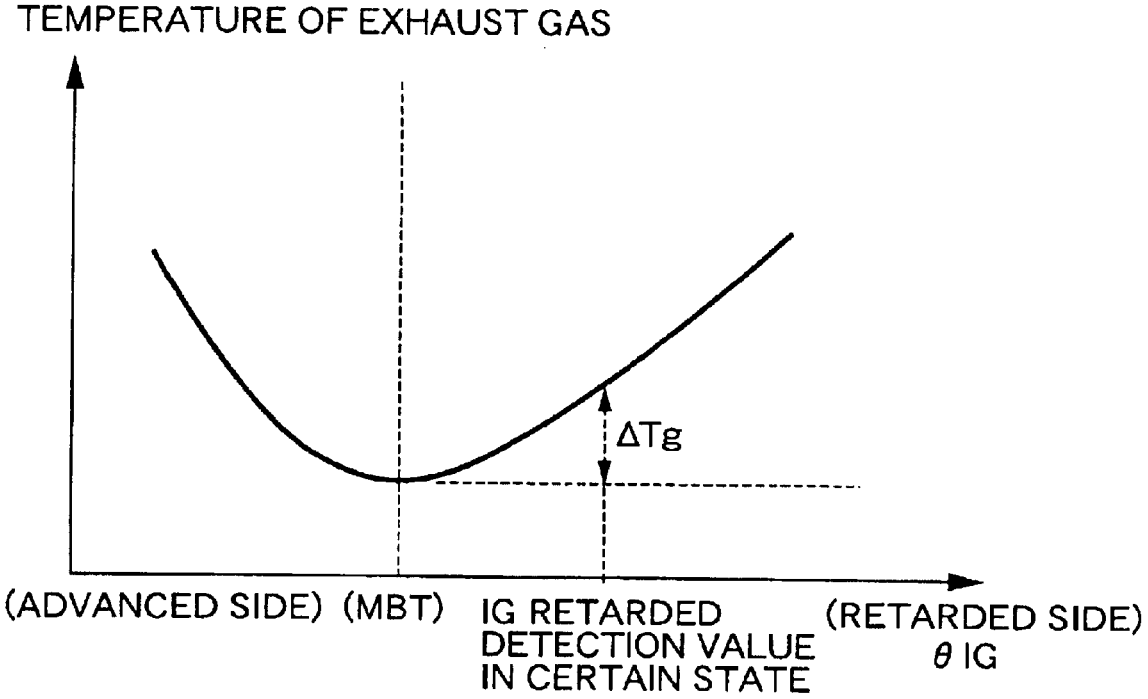
Figure 7:
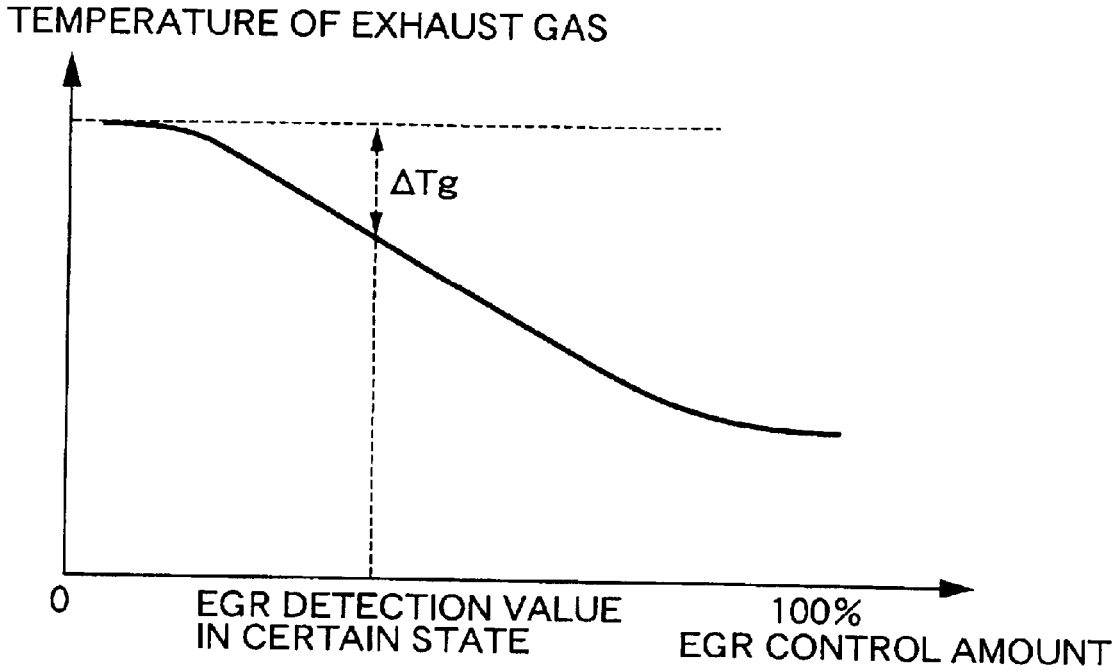
Figure 8:
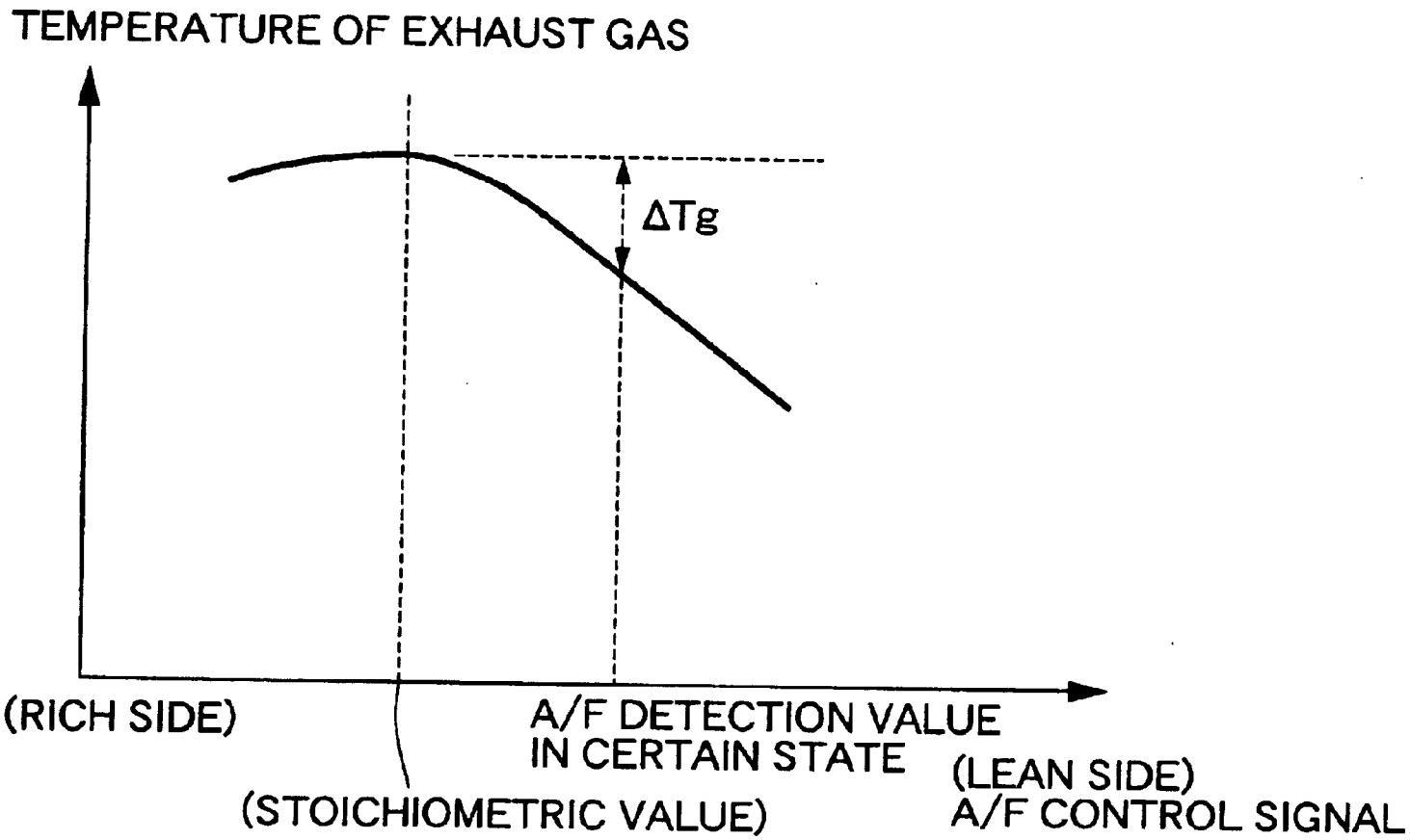

If an ignition-retarding control exerting an influence to the burned state of the engine 1 is being conducted at subsequent Step S5, an amount ΔTg of variation in energy of the exhaust gas (temperature Tg of the exhaust gas) corresponding to an ignition-retarding amount is searched based on a map shown in FIG. 6 at Step S6. The temperature Tg of the exhaust gas assumes the smallest value, when the ignition time is an optimal ignition time (MBT), and the temperature Tg of the exhaust gas is increased by the amount ΔTg of variation in accordance with an increase in amount of ignition time delayed and advanced from the optimal ignition time. If an EGR control exerting an influence to the burned state of the engine 1 is being conducted at subsequent Step S7, an amount ΔTg of variation in energy of the exhaust gas (temperature Tg of the exhaust gas) corresponding to an EGR control amount is searched based on a map shown in FIG. 7 at Step S8. The temperature Tg of the exhaust gas is decreased by the amount ΔTg of variation in accordance with an increase in EGR amount from 0. If an air fuel ratio control exerting an influence to the burned state of the engine 1 is being conducted at subsequent Step S9, an amount ΔTg of variation of the energy of the exhaust gas (temperature Tg of the exhaust gas) corresponding to an air fuel ratio control amount is searched based on a map shown in FIG. 8 at Step S10. The temperature Tg of the exhaust gas is decreased by the amount ΔTg of variation in accordance with a variation in air fuel ratio from a stoichiometric value (a theoretic air fuel ratio) toward a lean value or a rich value.

If the engine 1 is in the fuel-cut operation at Step S3, all of the amounts ΔTg of variation in temperature Tg of the exhaust gas at Steps S6, S8 and S10 are set at 0.

At subsequent Step S11, the temperature of the exhaust gas of the energy of the exhaust gas calculated at Step S4 is corrected using the amounts ΔTg of variation in temperature Tg of the exhaust gas calculated at Steps S6, S8 and S10; an energy of the exhaust gas after the correction is calculated, and an amount Qw of water supplied (a feedforward control value) for equalizing the actual temperature Ts of the vapor generated in the evaporator 3 to the target vapor temperature Tst is calculated based on this energy of the exhaust gas. At Step S12, the amount Qw of water supplied is subjected to a filtering in consideration of the delay of the responses of the engine 1 and the evaporator 3. At subsequent Step S13, a difference Ts−Tst between the actual vapor temperature Ts and the target vapor temperature Tst is subjected to a PID processing to calculate an amount Qw of water supplied (a feedback control amount) for equalizing the actual vapor temperature Ts to the target vapor temperature Tst. At Step S14, a value of addition of the feedforward control value and the feedback control value is calculated, and at Step S15, the amount Qw of water supplied from the supplied-water amount control injector 7 to the evaporator 3 is controlled based on the addition value.

As described above, the following two controls are used in combination: the feedforward control for controlling the amount Qw of water supplied to the evaporator 3 based on the engine rotational speed NE and the engine load PB; and the feedback control for controlling the amount Qw of water supplied based on the difference between the actual temperature Ts of the vapor generated in the evaporator 3 and the target vapor temperature Tst. Therefore, it is possible to equalize the actual vapor temperature Ts to the target vapor temperature Tst, while achieving both of the responsiveness and the convergence. Moreover, the feedforward control value is corrected based on the parameters indicating the burned state of the engine 1 which exerts the influence directly to the temperature Tg of the exhaust gas from the engine 1, i.e., the fuel-cut control signal, the ignition-retarding control signal, the EGR control signal and the air fuel ratio control signal and hence, the actual temperature Ts of the vapor generated by the evaporator 3 can be controlled with a high accuracy to the target vapor temperature Tst even in a transient state of the engine 1.

Although the embodiment of the present invention has been described in detail, it will be understood that the present invention is not limited to the above-described embodiment, and various modifications in design may be made.

For example, the fuel-cut control signal, the ignition-retarding control signal, the EGR control signal and the air fuel ratio control signal are used as the parameters indicating the burned state of the engine 1 in the embodiment, but all of them need not necessarily be used, and at least one of them may be used. In addition, the intake negative pressure PB is used as the engine load in the embodiment, but another parameter such as a throttle opening degree may be used.

INDUSTRIAL APPLICABILITY

As discussed above, the vapor-temperature control unit for the evaporator according to the present invention can be utilized suitably for an evaporator in a Rankine cycle system for a vehicle, but it can also be utilized to an evaporator for any application other than a Rankine cycle system.

What is claimed is:

1. A vapor-temperature control system for an evaporator for controlling an actual temperature (Ts) of a vapor generated by an evaporator (3) for heating a liquid-phase working medium by an exhaust gas from an engine (1) to a target vapor temperature (Tst), characterized in that said system comprises a liquid-phase working medium supply amount varying means (7) for varying the amount of liquid-phase working medium supplied to the evaporator (3), and a control means (11) for controlling the amount of liquid-phase working medium supplied by the liquid-phase working medium supply amount varying means (7), based on a parameter indicating the burned state of the engine (1).

2. A vapor-temperature control system for an evaporator according to claim 1, wherein said parameter indicating the burned state of the engine (1) is at least one of a fuel-cut control signal, an ignition-retarding control signal, an EGR control signal and an air fuel ratio control signal.

3. A vapor-temperature control system for an evaporator according to claim 1 or 2, wherein said control means (11) includes a feedforward control means (17) for controlling the amount of liquid-phase working medium supplied in accordance with an engine rotational speed (NE) and an engine load (PB), and a feedback control means (18) for controlling the amount of liquid-phase working medium supplied, based on a difference between the actual vapor temperature (Ts) and the target vapor temperature (Tst).

* * * * *